United States Patent [19]

Klotzman

[11] 4,134,040

[45] Jan. 9, 1979

[54] ADAPTER FOR WIRE ELECTRODE ASSEMBLY OF AN ELECTROSTATIC PRECIPITATOR

[75] Inventor: Melvin B. Klotzman, Randallstown, Md.

[73] Assignee: Koppers Company, Inc., Pittsburgh, Pa.

[21] Appl. No.: 843,633

[22] Filed: Oct. 19, 1977

[51] Int. Cl.[2] ..... H01J 1/94

[52] U.S. Cl. ..... 313/271; 313/292; 313/278; 313/237; 313/333; 248/339; 55/148

[58] Field of Search ..... 248/339, 340, 341, 58; 55/146–148, 150, 151; 313/331, 271, 237, 238, 292, 333

[56] References Cited

U.S. PATENT DOCUMENTS

| | | | |
|---|---|---|---|
| 2,666,495 | 1/1954 | Hull | 55/150 X |
| 2,866,517 | 12/1958 | Phyl | 55/147 X |
| 3,109,720 | 11/1963 | Cummings et al. | 55/13 |
| 3,483,670 | 12/1969 | Quintilian et al. | 55/147 X |
| 3,483,671 | 12/1969 | Wiemer | 55/147 X |
| 3,485,011 | 12/1969 | Archer et al. | 55/2 |
| 3,774,372 | 11/1973 | Heer et al. | 55/146 |
| 3,783,589 | 1/1974 | Ertl et al. | 55/146 |

*Primary Examiner*—Alfred E. Smith
*Assistant Examiner*—Charles F. Roberts
*Attorney, Agent, or Firm*—Herbert J. Zeh, Jr.; Oscar B. Brumback

[57] ABSTRACT

An adapter for wire electrode assemblies of electrostatic precipitators so that wire electrodes of the type comprising an elongated electrode wire having its opposite ends terminating axially within two identical shrouds, each of the shrouds shaped as an elongated rod terminating in a combined frusto-cone and enlarged button head may be used with all types of support structures. The adapter comprises a curved or hook shaped piece of metal or other suitable material having in one end thereof a vertically aligned hole or slot adapted to cooperate with a bolt or pin, and in the other end thereof a horizontally aligned keyhole or slot adapted to receive the frusto-conical shroud of a wire electrode, the centers of the vertically aligned hole and horizontally aligned hole being in the same vertical plane.

4 Claims, 11 Drawing Figures

ADAPTER FOR WIRE ELECTRODE ASSEMBLY OF AN ELECTROSTATIC PRECIPITATOR

BACKGROUND OF THE INVENTION

This invention relates generally to gas separation devices such as electrostatic precipitators and, more particularly, to an adapter for electrical discharge wire electrode assemblies that permits existing wire electrode assemblies to be converted to wire electrodes of the type comprising an elongated wire having its opposite ends terminating axially within two identical shrouds, each of the shrouds shaped as an elongated rod terminating in a combined frusto-cone and enlarged button head.

Conventional electrostatic precipitators are used to remove foreign particles from a gas stream and are generally described in Cummings, et al., U.S. Pat. No. 3,109,720; Quintilian, et al., U.S. Pat. No. 3,483,670; Phyl, U.S. Pat. No. 2,866,517; Archer, et al., U.S. Pat. No. 3,485,011; Wiemer, U.S. Pat. No. 3,483,671; Ertl, el al., U.S. Pat. No. 3,783,589; Hull, U.S. Pat. No. 2,666,495 and Heer et al., U.S. Pat. No. 3,774,372. The electrostatic precipitators are generally made up of a plurality of grounded collecting electrodes and a high voltage discharge electrode in spaced relationship to each other and which are suspended from a supporting structure in a precipitator shell.

A uni-directional high potential field is set up between the collecting and discharge electrodes and at a critical voltage a corona discharge takes place resulting in an ion discharge. The bulk of the foreign particles in the gas stream passing between the electrodes become negatively charged as a result of the ion discharge and, consequently, are attracted to the grounded collecting electrodes and accumulate thereon, although a few of the particles may be attracted to the discharge electrodes.

Rappers or vibrators, such as described and illustrated in Pennington U.S. Pat. No. 3,030,753, are attached to the collecting and discharge electrode support structure to remove the particles collected thereon by producing vibrations of the electrodes and causing the accumulated particles to jar or vibrate loose and fall downwardly of their own weight into suitable collecting means well known in the art.

The collecting electrodes are usually constructed of flat metal plates suitably connected together, whereas the discharge electrodes have taken the form of elongated wires, ribbons or rods connected to the support structure in any one of several ways, such as bolting, welding, or clamping the electrode to the supporting structure.

It is well known, however, that the discharge electrodes are more sensitive to rapping or vibrating than the collecting electrodes and therefore have required the most attention as to the method of suspension because of fatigue and subsequent mechanical failure. It is also well known that rapping of the discharge electrodes imparts a relatively large deflection to the electrodes, resulting in severe localized stresses occurring at the upper and lower points of suspension of the electrodes. It is at these points that breakage and failure of the electrodes have for the most part been concentrated. Conventional connecting or suspensory means generally have made little or no provision to reduce or obviate these highly stressed conditions. Consequently, when a discharge electrode fails, it is often necessary to interrupt the operation of the precipitator to repair or replace the broken electrode, otherwise, a hazardous and undesirable arc-over is likely to occur between the broken electrode and the grounded collecting electrode. Such interruptions are not only costly, but in addition, repairing or replacing the broken electrode is usually difficult.

Present methods of connecting the discharge electrodes to the support structure or weight means create difficulties of their own, particularly difficulty in replacing broken electrode wires. Replacing bolted connections is time-consuming and often proves destructive to the support structure or weight means when attempts are made to remove or dislodge rusted bolts. Additionally, it is very time-consuming and expensive to replace electrode wires that are attached to the support structure and weights by bolt means or similar means.

In order to overcome these problems, an electrode wire discharge assembly was developed in which the electrode wires has its opposite ends terminating axially within two identical shrouds, each of the shrouds is shaped as an elongated rod terminating in a combined frusto-cone and enlarged button head. In assembly, one of the frusto-conical ends of the shroud seats on a keyhole slot located in a support frame while the other frusto-conical end of the shroud seats on the edges of a transverse slot located in a cylindrical weight adapted to receive the shroud. While such a wire electrode offers advantages over the prior art wire electrodes, they can only be used in precipitators in which the support system and weights are designed to cooperate with the frusto-conical shaped shrouded electrodes. Accordingly, it is the object of this invention to provide an adapter so that such improved wire electrodes and their ease of changing can be used with existing precipitators.

SUMMARY OF THE INVENTION

The present invention is directed to an adapter for electrostatic precipitators, particularly an adapter that allows existing precipitators to be modified to use wire electrodes of the type comprising an elongated electrode wire having its opposite ends terminating axially within two identical shrouds, each of the shrouds shaped as an elongated rod terminating in a combined frusto-cone and enlarged button head. The adapter comprises a suitably shaped piece of metal or other suitable material having in one end thereof a vertically aligned hole or slot adapted to cooperate with an S-hook bolt, pin or the like for attachment to an electrode wire support structure or stabilizing weights and, in the other end thereof, a horizontally aligned keyhole or slot adapted to receive the frusto-conical shaped shroud of a wire electrode, the vertically aligned hole and the horizontally aligned keyhole being in planes that are perpendicular to each other and having their respective centers in the same vertical plane.

Adapters having the above described properties allow existing precipitators to be readily retrofitted with wire electrodes of the type comprising an elongated electrode wire having its opposite ends terminating axially within two identical shrouds, each of the shrouds shaped as an elongated rod terminating in a combined frusto-cone and enlarged button head. Such wire electrodes are an improvement over the wire electrodes of the prior art. Once installed, such wire electrodes are also easily replaced.

The above and other objects and novel features of the present invention will appear more fully from the following detailed description when the same is read in connection with the accompanying drawings. It is to be expressly understood, however, that the drawings are not intended as a definition of the invention but are for the purposes of illustration only.

In the drawings wherein like parts are marked alike:

Figure 1:
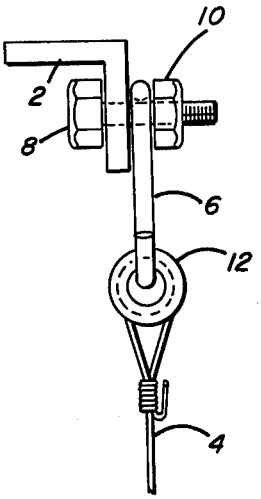
FIG. 1 is a side view of a typical prior art wire electrode and method of connecting the same to a support structure.
Figure 2:
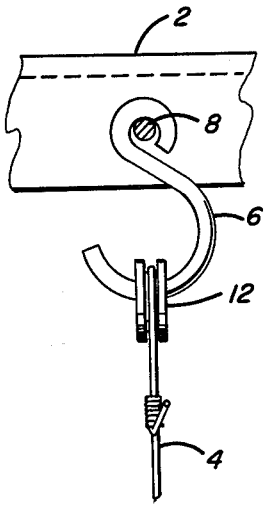
FIG. 2 is a front view of the wire electrode and support of FIG. 1.

With reference to FIGS. 1–4, there is shown one of the methods used in the prior art for attaching the wire electrodes to the support structure and stabilizing weights. In FIGS. 1 and 2, there is shown a support structure 2 from which is hanging wire electrode 4. Wire electrode 4 is connected to support structure 2 by S-hook 6. The top of S-hook 6 is secured to the support by bolt means 8 and nut means 10. Alternatively, other means of attaching S-hook 6 to support means 2 may be used such as a pin, washer and cotter pin, or even by welding. Wire electrode 4 is attached to the bottom of S-hook 6 by a doughnut-shaped piece of metal 12 which is attached to the end of wire electrode 4. Other suitable means for attaching the end of wire electrode 4 to S-hook 6 are also readily available.

It is also possible to attach the wire electrode directly to the support structure without an S-hook. Many prior art methods do not employ an S-hook. For example, see Phyl, U.S. Pat. No. 2,866,517, particularly FIGS. 2, 3 and 4, for an alternative way of attaching electrode wires to the support structure and stabilizing weights. For additional alternative methods, see Archer, et al., U.S. Pat. No. 3,485,011, and Ertl, et al., U.S. Pat. No. 3,783,589.

Figure 3:
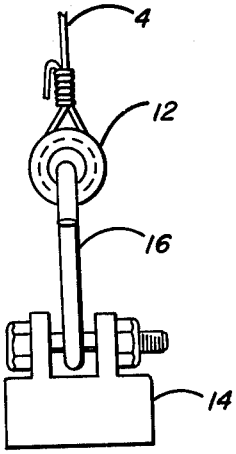
FIG. 3 is a side view of a typical prior art wire electrode connected to stabilizing weights.
Figure 4:
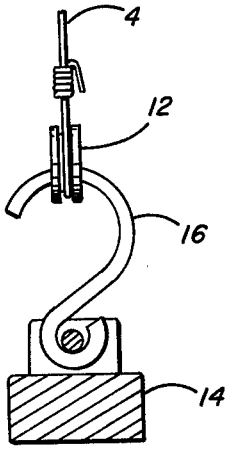
FIG. 4 is a front view of the wire electrode connected to stabilizing weights of FIG. 3.

In FIGS. 3 and 4, there is shown a stabilizer weight 14 attached to the bottom of wire electrode 4. The weight is attached by an S-hook 16 similar to S-hook 6. S-hook 16 is attached to the bottom of wire electrode 4 by doughnut 12 which is attached to the end of wire electrode. The weight 14 is attached to the other end of the S-hook by nut 8 and bolt 10 or by other suitable means such as welding or a pin, washer and cotter pin.

It is also possible to attach the weight directly to the end of the wire electrode without using an S-hook. For examples of such methods, see the patents mentioned above.

Figure 5:
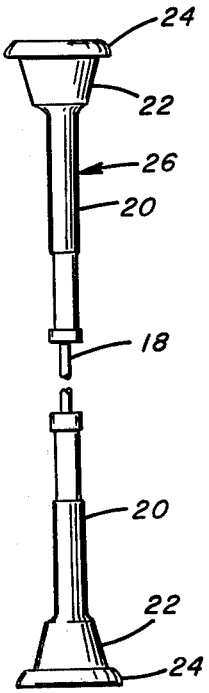
FIG. 5 is an illustration of an electrode wire of importance to the present invention.

FIG. 5 shows a wire electrode 26 that is preferred for use in electrostatic precipitators. The electrode wire consists of an elongated wire 18 having its opposite ends terminating within identical shrouds 20. Each shroud is shaped as a rod having one of its outer ends taper outwardly in a frustoconical portion 22, which portion terminates in or is capped by an enlarged button head 24. In assembly, the electrode wire 26 is vertically suspended from a support structure having a keyhole slot adapted to cooperate with the frusto-conical section of the electrode wire. The frusto-conical section of the shroud is seated in the keyhole slot. The enlarged button head portion of the shroud also prevents the shroud from falling out in case the keyhole slot becomes worn. An electrode weight is provided for hanging on the bottom of the wire to give tensioning to the electrode assembly. The weight is provided with a slot that will cooperate with the frusto-conical section of the shroud in the same manner as the keyhole slot in the support structure. The details of the support frame, keyhole slot, and tensioning weight are given in Quintilian et al., U.S. Pat. No. 3,483,670.

As can be seen from FIGS. 1–5, the electrode wire of FIG. 5 cannot be readily used with support structures or weight structures such as described in FIGS. 1–4. However, it is desirable in many instances to use wire electrodes as described in FIG. 5 in electrostatic precipitators that were originally equipped with systems similar to or the same as those described in FIGS. 1–4. Accordingly, the invention provides an adapter that allows wire electrodes similar to or the same as those illustrated in FIG. 5 to be used with electrostatic precipitators originally designed similar to or the same as those illustrated by FIGS. 1–4.

The adapter is a piece of metal or other suitable material of construction that has a vertically aligned hole or slot in one end thereof adapted to cooperate with an S-hook bolt and nut means, or similar means, for hanging from a support structure. In the other end thereof is a horizontally aligned keyhole for cooperation with the frusto-conical shaped shroud of the electrode wire. The piece of metal is shaped such that the horizontal keyhole slot and the vertical hole are in planes perpendicular to each other and their centers are in the same vertical plane. The metallic adapter may be in the form of a piece of sheet metal, a rod, a thick piece of wire, or any other form that can be shaped as required.

Figure 6:
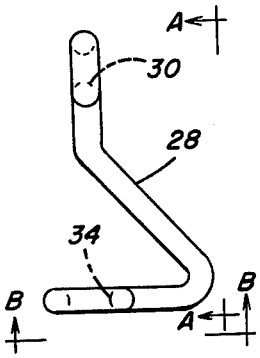
FIG. 6 is a side view of an electrode wire adapter of the present invention made from a metallic rod or thick wire.
Figure 7:
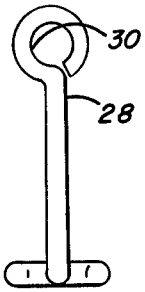
FIG. 7 is a view along AA of FIG. 6.
Figure 8:
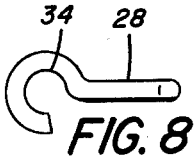
FIG. 8 is a view along BB of FIG. 6.

With respect to FIGS. 6, 7 and 8, there is shown an adapter of the present invention formed from a wire rod 28 or thick piece of wire. At one end of the wire is formed a hole 30 with its opening aligned in the vertical position. Hole 30 is of such size as to fit around a bolt, rod, or pin attached to or extending from a support structure or a stabilizing weight. Alternatively, hole 28 will go on an S-hook in a manner similar to the doughnut 12 shown in FIG. 1–4. At the other end of rod 28 is a keyhole 34 with its opening aligned in a horizontal position. Keyhole 34 is of such a size and shape as to cooperate with frusto-conical shroud 22 with button head 24 of a wire electrode. The rod is suitably shaped so that keyhole 34 and hole 32 are in planes that are perpendicular to each other and the center of keyhole 34 and hole 32 are in the same vertical plane.

Figure 9:
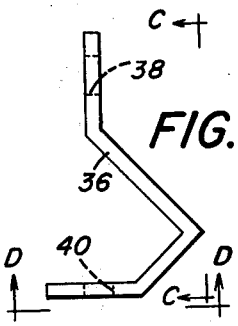
FIG. 9 is a side view of an electrode wire adapter of the present invention made from sheet metal.
Figure 10:
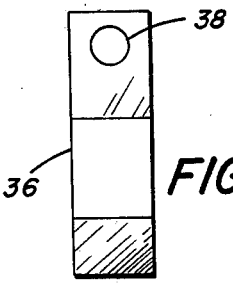
FIG. 10 is a view along CC of FIG. 9.
Figure 11:
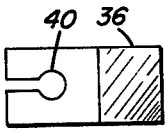
FIG. 11 is a view along DD of FIG. 9.

With respect to FIGS. 9, 10 and 11, there is illustrated an adapter made from a piece of sheet metal 36. At one end of the piece of metal is a hole 38 with its opening aligned in the vertical position. Hole 38 is of such size as to cooperate with an S-hook, bolt, rod, or pin, or the like to attach the adapter to the support structure of the precipitator or to attach stabilizing weights to the bottom of an electrode wire. At the other end of the piece of metal is a keyhole 40 with its opening aligned in a horizontal position. Keyhole 40 is of such size and shape as to cooperate with the frusto-conical shroud 22 with button head 24 of a wire electrode. The sheet of metal is suitably shaped so that hole 38 and keyhole 40 are in planes that are perpendicular to each other and their centers are in the same vertical plane.

In assembly, the vertically aligned hole such as 30 or 38 of an adapter is attached to the support structure by an S-hook as in FIGS. 1 and 2, or directly to the support structure via a bolt, rod, or pin. A wire electrode similar to FIG. 5 is then attached to the adapter with the frusto-conical shaped shroud with button head seating in the horizontally aligned keyhole such as 34 or 40. A second adapter is attached to the bottom of the wire electrode. Keyhole 34 or 40 of the bottom adapter is seated on the frusto-conical shaped shroud with button head on the bottom of the electrode wire. Hole 32 or 38 then cooperates with an S-hook, bolt, rod, pin or the like to attach a stabilizing weight.

From the above it can be seen that the important feature of the adapter is having the vertical hole and horizontal keyhole in perpendicular planes and having their respective centers in the same vertical plane. In this manner, the electrode wires can be hung in the desired vertical position. The adapter may be made of any suitable material of construction that will withstand the operating conditions of the electrostatic precipitator and that will support the stabilizing weight. The term "metal" as used herein is meant to be inclusive of all such materials of construction. The adapter may be of any suitable shape, so long as the hole and keyhole have the above described properties. The preferred shape is a modified Z-shape with the top of the Z being vertical rather than horizontal.

What is claimed:

1. An adapter for wire electrode assemblies of electrostatic precipitators that enable the use of wire electrodes of the type comprising an elongated electrode wire having its opposite ends terminating axially within shrouds, each shroud shaped as an elongated rod terminating in a combined frusto-cone and enlarged button head, said adapter comprising a piece of metal having in one end thereof a vertically aligned hole that is designed to attach the adapter to a support structure, and in the other end thereof, a horizontally aligned keyhole that is designed to cooperate with the frusto-conical shroud of the wire electrode, the metal being shaped so that the keyhole and hole are in planes that are perpendicular and their centers are in the same vertical plane.

2. An adapter as in claim 1 in which the adapter is made from a piece of sheet metal.

3. An adapter as in claim 1 in which the adapter is made from a metallic rod.

4. An adapter as in claim 1 which is in the shape of a modified Z with the top of the Z being vertical rather than horizontal.

* * * * *